US008393384B2

(12) United States Patent
Velte et al.

(10) Patent No.: US 8,393,384 B2
(45) Date of Patent: Mar. 12, 2013

(54) STACKED-PLATE HEAT EXCHANGER, IN PARTICULAR CHARGE-AIR COOLER

(75) Inventors: Volker Velte, Ötisheim (DE); Horst Rothenhöfer, Lauffen (DE)

(73) Assignee: Behr Industry GmbH & Co. KG, Stuttgart (DE)

( * ) Notice: Subject to any disclaimer, the term of this patent is extended or adjusted under 35 U.S.C. 154(b) by 1255 days.

(21) Appl. No.: 12/066,901

(22) PCT Filed: Sep. 7, 2006

(86) PCT No.: PCT/EP2006/008737

§ 371 (c)(1),
(2), (4) Date: Jun. 16, 2008

(87) PCT Pub. No.: WO2007/031230

PCT Pub. Date: Mar. 22, 2007

(65) Prior Publication Data

US 2008/0264619 A1 Oct. 30, 2008

(30) Foreign Application Priority Data

Sep. 16, 2005 (DE) ..... 10 2005 044 291

(51) Int. Cl.
*F28F 3/08* (2006.01)
*F28F 3/14* (2006.01)

(52) U.S. Cl. ..... 165/167; 165/170

(58) Field of Classification Search ..... 165/153, 165/165, 166, 167, 170
See application file for complete search history.

(56) References Cited

U.S. PATENT DOCUMENTS 3,334,399 A * 8/1967 Teeguarden ..... 29/890.039
4,291,760 A * 9/1981 Argyle et al. ..... 165/166
4,823,868 A 4/1989 Neebel
5,174,370 A * 12/1992 Hallgren ..... 165/166
5,409,058 A 4/1995 Yuasa et al.
(Continued)

FOREIGN PATENT DOCUMENTS

DE 198 53 455 A1 6/1999
DE 695 19 806 T2 8/2001
(Continued)

OTHER PUBLICATIONS

Notice of Provisional Rejection mailed Oct. 24, 2012 in related Korean Appl. No. 10-2008-7009125 (8 pgs.).

*Primary Examiner* — Tho V Duong
(74) *Attorney, Agent, or Firm* — Foley & Lardner LLP

(57) ABSTRACT

The invention relates to a stacked-plate heat exchanger, in particular a charge-air cooler, having a plurality of elongate plates (1-3;21-23;51-53) which are stacked on top of one another and are connected, in particular soldered, to one another, which plates (1-3;21-23;51-53) delimit a cavity (55-57) for conducting a medium to be cooled, for example charge air, in the longitudinal direction of the plates, and a further cavity (63-65) for conducting a coolant, wherein the plates (1-3;21-23;51-53) have in each case one inlet port and one outlet port for the medium which is to be cooled. In order to provide a stacked-plate heat exchanger which can be produced cost-effectively and has a long service life even at high temperatures, according to the invention, at least one coolant port (14-16) extends partially around a port (12) for the medium to be cooled.

11 Claims, 7 Drawing Sheets

U.S. PATENT DOCUMENTS

| | | | | |
|---|---|---|---|---|
| 6,073,616 | A | 6/2000 | Hedman | |
| 6,152,216 | A * | 11/2000 | Schwab et al. | 165/167 |
| 6,170,568 | B1 | 1/2001 | Valenzuela | |
| 6,752,202 | B2 * | 6/2004 | Holm et al. | 165/167 |
| 2002/0000310 | A1 * | 1/2002 | Cheadle | 165/167 |
| 2003/0047303 | A1 * | 3/2003 | Andersson | 165/167 |
| 2003/0098146 | A1 * | 5/2003 | Angermann et al. | 165/167 |
| 2004/0040697 | A1 | 3/2004 | Pierre et al. | |
| 2005/0056412 | A1 | 3/2005 | Reinke et al. | |
| 2005/0230091 | A1 | 10/2005 | Brost et al. | |
| 2007/0131402 | A1 | 6/2007 | Hendrix et al. | |

FOREIGN PATENT DOCUMENTS

| | | | |
|---|---|---|---|
| DE | 103 52 880 | A1 | 6/2005 |
| DE | 10 2004 018 197 | A1 | 11/2005 |
| EP | 0 343 565 | A2 | 11/1989 |
| WO | WO 00/46564 | A1 | 8/2000 |
| WO | WO 01/90671 | A1 | 11/2001 |
| WO | WO 02/053998 | A1 | 7/2002 |
| WO | WO 2005045344 | A1 * | 5/2005 |

* cited by examiner

STACKED-PLATE HEAT EXCHANGER, IN PARTICULAR CHARGE-AIR COOLER

The invention relates to a stacked-plate heat exchanger, in particular a charge-air cooler, having a plurality of elongate plates which are stacked one on top of the other and are connected, in particular soldered, to one another, which plates delimit a cavity for conducting through a medium to be cooled, such as for example charge air, in the longitudinal direction of the plates, and a further cavity for conducting through a coolant, with the plates having in each case one inlet connection and one outlet connection for the medium to be cooled.

It is an object of the invention to create a stacked-plate heat exchanger as per the preamble of claim 1 which can be produced cost-effectively and which has a long service life even at high temperatures. The stacked-plate heat exchanger according to the invention should in particular be suitable for use in ship engine rooms.

The object is achieved, in a stacked-plate heat exchanger, in particular a charge-air cooler, having a plurality of elongate plates which are stacked one on top of the other and are connected, in particular soldered, to one another, which plates delimit a cavity for conducting through a medium to be cooled, such as for example charge air, in the longitudinal direction of the plates, and a further cavity for conducting through a coolant, with the plates having in each case one inlet connection and one outlet connection for the medium to be cooled, in that at least one coolant connection extends partially around a connection for the medium to be cooled. The coolant connection is preferably in the form of a slot through the plate, which slot extends partially around the connection for the medium to be cooled.

One preferred exemplary embodiment of the stacked-plate heat exchanger is characterized in that a plurality of coolant connections are arranged partially around the connection for the medium to be cooled. The coolant connections preferably have in each case the shape of a slot through the plate, which slot extends partially around the connection for the medium to be cooled.

A further preferred exemplary embodiment of the stacked-plate heat exchanger is characterized in that at least one coolant inlet connection extends partially around the outlet connection for the medium to be cooled. The coolant inlet connection is preferably in the form of a slot through the plate, which slot extends partially around the outlet connection for the medium to be cooled.

A further preferred exemplary embodiment of the stacked-plate heat exchanger is characterized in that a plurality of coolant inlet connections are arranged partially around the outlet connection for the medium to be cooled. The coolant inlet connections preferably have in each case the shape of a slot through the plate, which slot extends partially around the outlet connection for the medium to be cooled.

A further preferred exemplary embodiment of the stacked-plate heat exchanger is characterized in that the inlet connection and/or the outlet connection for the medium to be cooled are/is formed in each case by a passage hole through the plate, which passage hole is substantially in the form of a circular segment, in particular of a semi-circle, or of a semi-circular annular plate or of a slot which is curved in the shape of a circular arc. The plates preferably have, at their ends, the shape of circular segments, in particular of semi-circles, which are arranged concentrically with respect to the circular-segment-shaped or semi-circular or semi-circular annular-plate-shaped or circular-arc-shaped connections for the medium to be cooled.

A further preferred exemplary embodiment of the stacked-plate heat exchanger is characterized in that the coolant inlet connection and/or the coolant inlet connections and/or the coolant outlet connection and/or the coolant outlet connections are/is formed in each case by a passage hole through the plate, which passage hole is substantially in the form of a semi-circular annular plate, or of a circular-arc-shaped slot, which partially surrounds the inlet connection or the outlet connection for the medium to be cooled. The coolant connection(s) is (are) preferably arranged between the inlet connection or the outlet connection for the medium to be cooled and the environment.

A further preferred exemplary embodiment of the stacked-plate heat exchanger is characterized in that a further coolant inlet connection or coolant outlet connection is arranged in the region of the center of the semi-circular annular plate, or of the circular-arc-shaped slot, which forms the outlet connection or the inlet connection for the medium to be cooled. This ensures an increased dissipation of heat in a critical region of the stacked-plate heat exchanger.

A further preferred exemplary embodiment of the stacked-plate heat exchanger is characterized by a connection housing which has both a connection for the medium to be cooled and also a connection for the coolant. The connection housing is preferably a single-piece cast part.

A further preferred exemplary embodiment of the stacked-plate heat exchanger is characterized in that the connection housing has an encircling duct for the coolant which extends around a connection duct for the medium to be cooled. In this way, it is possible for the outer temperature of the stacked-plate heat exchanger to be kept below a critical value.

A further preferred exemplary embodiment of the stacked-plate heat exchanger is characterized in that the plates and/or the connection housing are/is formed from solderable aluminum. This facilitates the production of the stacked-plate heat exchanger.

Further advantages, features and details of the invention can be gathered from the following description, in which various exemplary embodiments are described in detail with reference to the drawing. Here, the features mentioned in the claims and in the description can be essential to the invention in each case individually or in any desired combination. In the drawing:

FIG. 9 shows a perspective illustration of a stacked-plate heat exchanger according to the invention;

Figure 1:
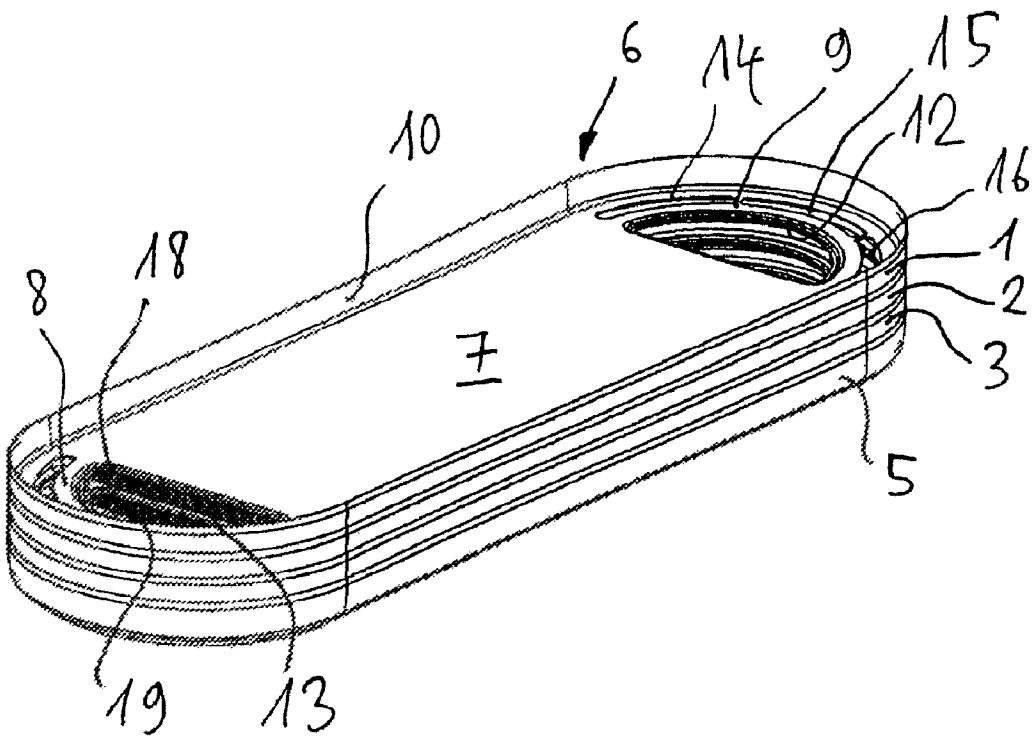
FIG. 1 shows a perspective illustration of a stacked-plate block of a stacked-plate heat exchanger according to the invention.

FIG. 1 illustrates three stacking plates 1 to 3 in a perspective view, which stacking plates 1 to 3 have been stacked one on top of the other on a base 5 to form a stacked-plate block 6. The three stacking plates 1 to 3 are of identical design and are soldered to one another.

The stacking plate 1 has, like the stacking plates 2 and 3, a rectangular base plate 7 with two semi-circular ends 8, 9. The stacking plate 1 is closed off to the outside by an encircling, turned-up edge 10. In each case one circular-segment-shaped passage hole 12, 13 is cut out in the semi-circular ends 8, 9 of the stacking plate 1. The passage holes 12, 13 constitute in each case a connection for charge air, through which charge air enters into and exits from a cavity which is delimited by the stacking plate 1 and which runs between the ends 8, 9.

Figure 2:
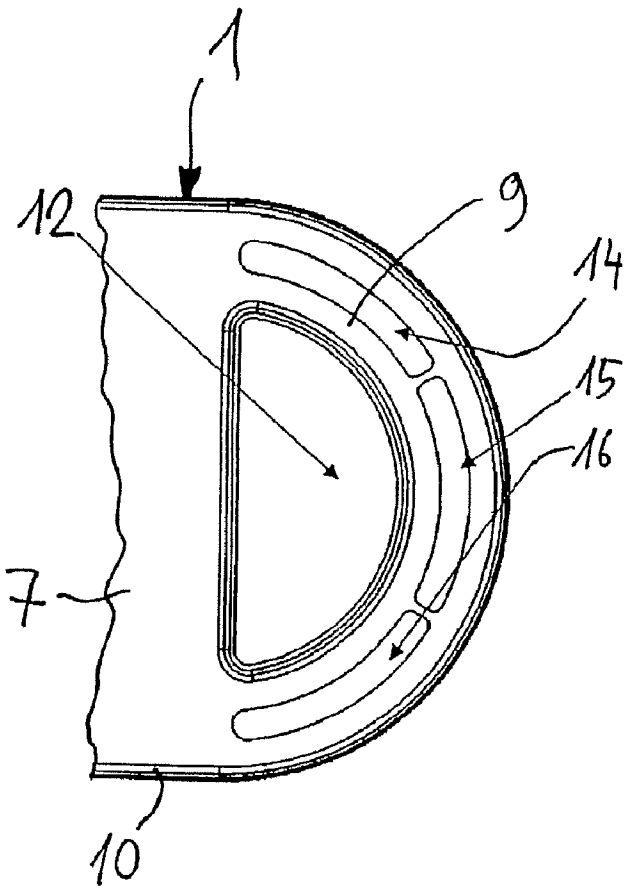
FIG. 2 shows one end of a stacking plate of the stacked-plate block from FIG. 1, in plan view.

FIG. 2 illustrates the end 9 of the stacking plate 1 in plan view. In the plan view, it can be seen that the circular-segment-shaped charge-air connection opening 12 is surrounded by three slots 14, 15, 16 which are curved in the shape of a circular arc. The three slots 14, 15, 16 are arranged between the semi-circle of the semi-circular or circular-segment-shaped passage hole 12 and the encircling peripheral edge 10 of the stacking plate 1. The slots 14 to 16 form connections for coolant. As a result of the arrangement of the coolant connections 14 to 16 around the charge-air connection 12, it is possible for the outer temperature of the stacked-plate block 6 to be kept below a critical limit value of 200 degrees Celsius. The outer temperature of the stacked-plate block 6 according to the invention is defined by the maximum coolant temperature.

In addition, the stacking plates 1 to 3 delimit in each case one cavity for charge air which extends between the passage holes 12, 13. Corrugated fins 18, 19 are arranged in the cavities of the charge air, which corrugated fins 18, 19 serve as guide devices for the charge air and to improve the heat transfer.

Figure 3:
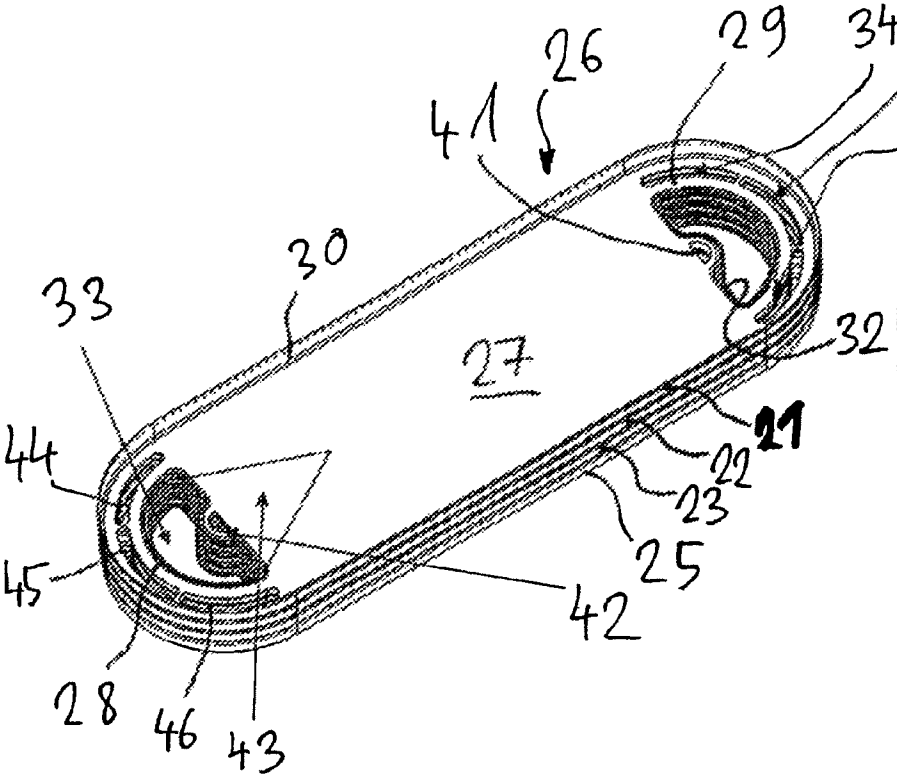
FIG. 3 shows the stacked-plate block from FIG. 1 in a further perspective view from above.

FIG. 3 illustrates three stacking plates 21 to 23 in a perspective view, which stacking plates 21 to 23 have been stacked one on top of the other on a base 25 to form a stacked-plate block 26. The stacking plate 21 has, like the stacking plates 22 and 23, a rectangular base plate 27 with two semi-circular ends 28, 29. In addition, the stacking plate 21 has an encircling, turned-up edge 30. At the ends 28, 29, the stacking plate 21 has in each case one slot 32, 33 which is curved in the shape of a circular arc. The slots 32, 33 form charge-air connections through which charge air passes into the cavities between the ends 28, 29 of the stacking plate 21.

Arranged radially outside the slots 32, 33 are slots 34 to 36, 44 to 46 which are likewise curved in the shape of a circular arc. The slots 34 to 36 and 44 to 46 form coolant connection openings through which coolant enters into and exits from the stacked-plate block 26. Also formed between or in the stacking plates 21 to 23 are cavities for conducting through the charge air, which cavities run between the charge-air connection openings 32, 33. Corrugated fins 38 to 40 are arranged in said cavities in a known way, which corrugated fins 38 to 40 serve to guide the charge air and to improve the heat transfer.

Provided radially within the charge-air connection openings 32, 33 is in each case one further passage hole 41, 42 which constitutes an additional coolant connection opening. The additional coolant connection openings 41, 42 ensure that a particularly critical region, which is marked at the end 28 of the stacking plate 21 by a triangle 43, is cooled more effectively. There is an insufficient flow through said region in conventional heat exchangers, and said region is therefore supplied with additional coolant in the stacked-plate heat exchanger according to the invention.

Figure 4:
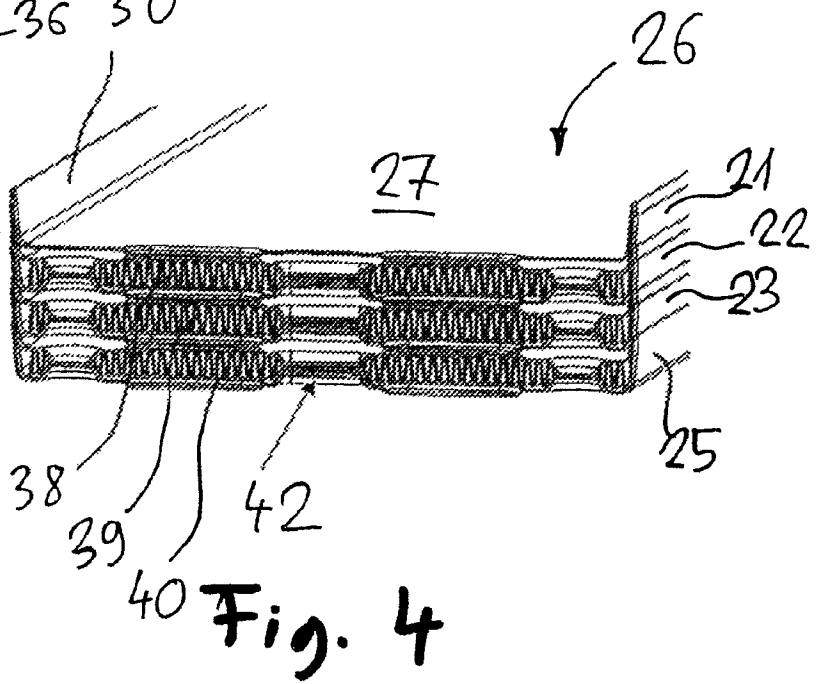
FIG. 4 shows the view of a section through one end of the stacked-plate block illustrated in FIG. 3.

FIG. 4 illustrates a cross section through the end 28 of the stacked-plate block 26 in FIG. 3. In the section view, it can be seen that in each case one corrugated fin 38 to 40 is arranged in the cavities for conducting through the charge air, as in the preceding exemplary embodiment.

Figure 5:
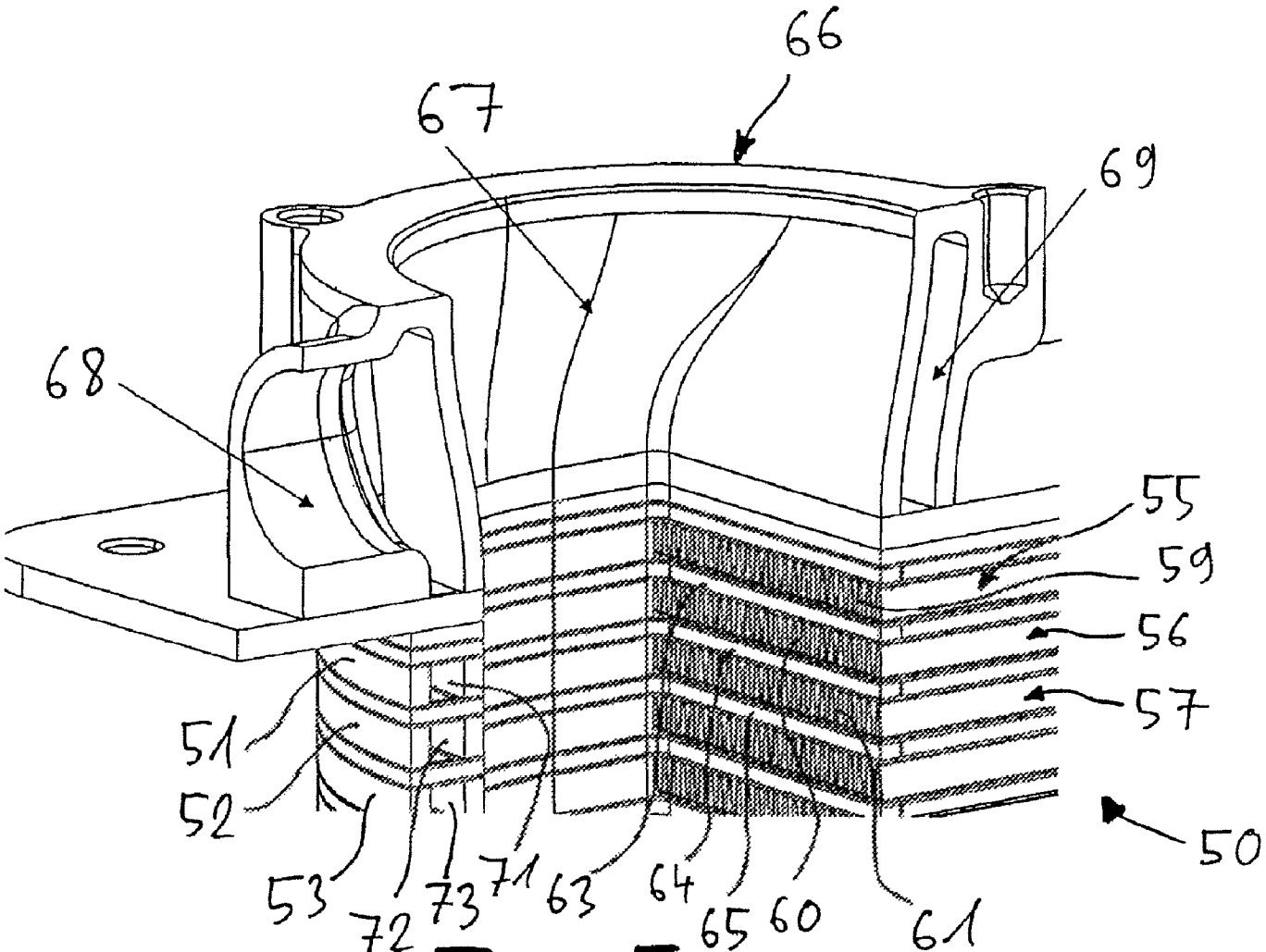
FIG. 5 shows a perspective section illustration through a connection housing of a stacked-plate heat exchanger according to the invention.

FIG. 5 illustrates, in a perspective section view, a stacked-plate block 50 as illustrated in various exemplary embodiments and views in the preceding figures. The stacked-plate block 50 comprises inter alia three stacking plates 51 to 53 which are constructed and designed like the stacking plates in one of the preceding exemplary embodiments. The stacking plates 51 to 53 delimit regions or layers 55 to 57 which are traversed by charge air. In each case one corrugated fin 59 to 61 is arranged in the regions 55 to 57 which are traversed by charge air. In each case one region which is traversed by coolant, or a layer 63 to 65 which is traversed by coolant, is arranged between two regions 55 to 57 which are traversed by charge air. The coolant in the layers 63 to 65 which are traversed by coolant serves to dissipate heat from the charge air in the regions 55 to 57 which are traversed by charge air.

Provided above the connection openings for charge air (12, 13 in FIG. 1 and 32, 33 in FIG. 3) in the stacking plates 51 to 53 is a connection housing 66. The connection housing 66 has a central charge-air connection duct 67 which is arranged coaxially with respect to, and as an extension of, the charge-air connection openings in the stacking plates 51 to 53. The connection housing 66 additionally has a coolant connection duct 68 which is arranged transversely with respect to the charge-air connection duct 67. The coolant connection duct 68 opens out into an encircling coolant duct 69 which runs radially outside the central charge-air connection duct 67. Further coolant ducts 71 to 73 are provided in the stacking plates 51 to 53 below the encircling coolant duct 69. The coolant ducts 71 to 73 are formed by slots in the stacking plates 51 to 53. Said slots are denoted in the preceding examples by 14 to 16, 34 to 36 and 44 to 46.

The connection housing 66 is a cast part composed of solderable aluminum. The cast part comprises both the charge-air connection duct 67 and also the coolant connection duct 68. It is also possible for the connection housing 66 to be of multi-part design.

Figure 7:
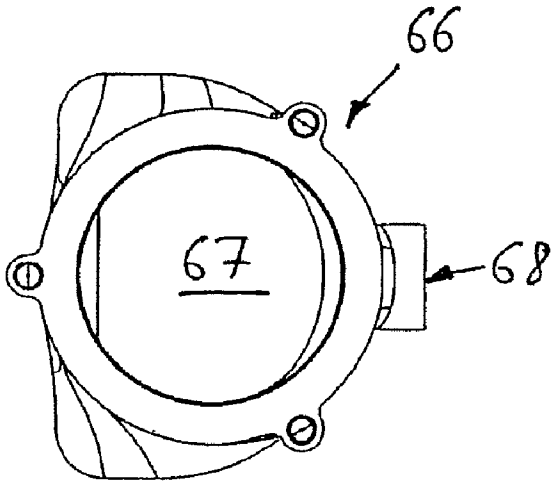
FIG. 7 shows the connection housing from FIG. 6 in plan view.
Figure 8:
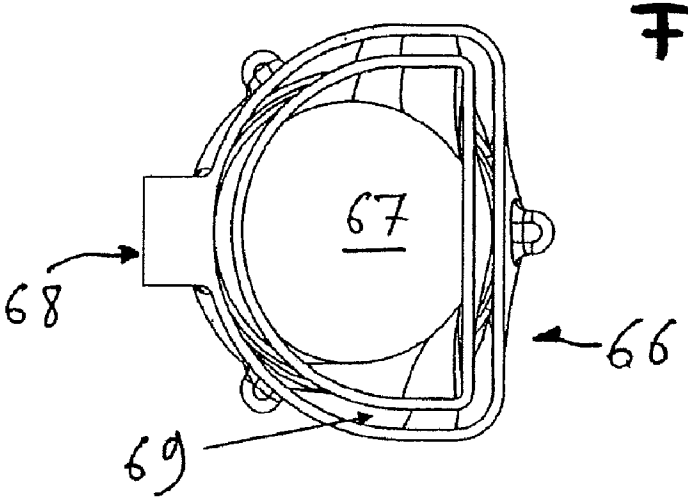
FIG. 8 shows the connection housing from FIG. 6 in cross section.
Figure 6:
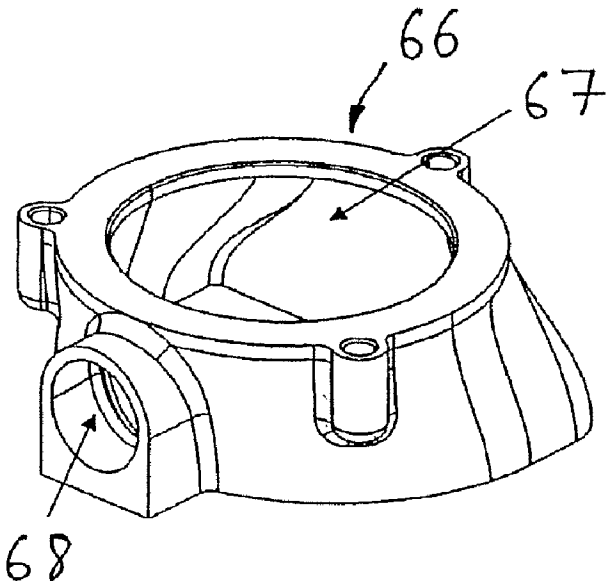
FIG. 6 shows a perspective illustration of the connection housing from FIG. 5 on its own.
Figure 6:
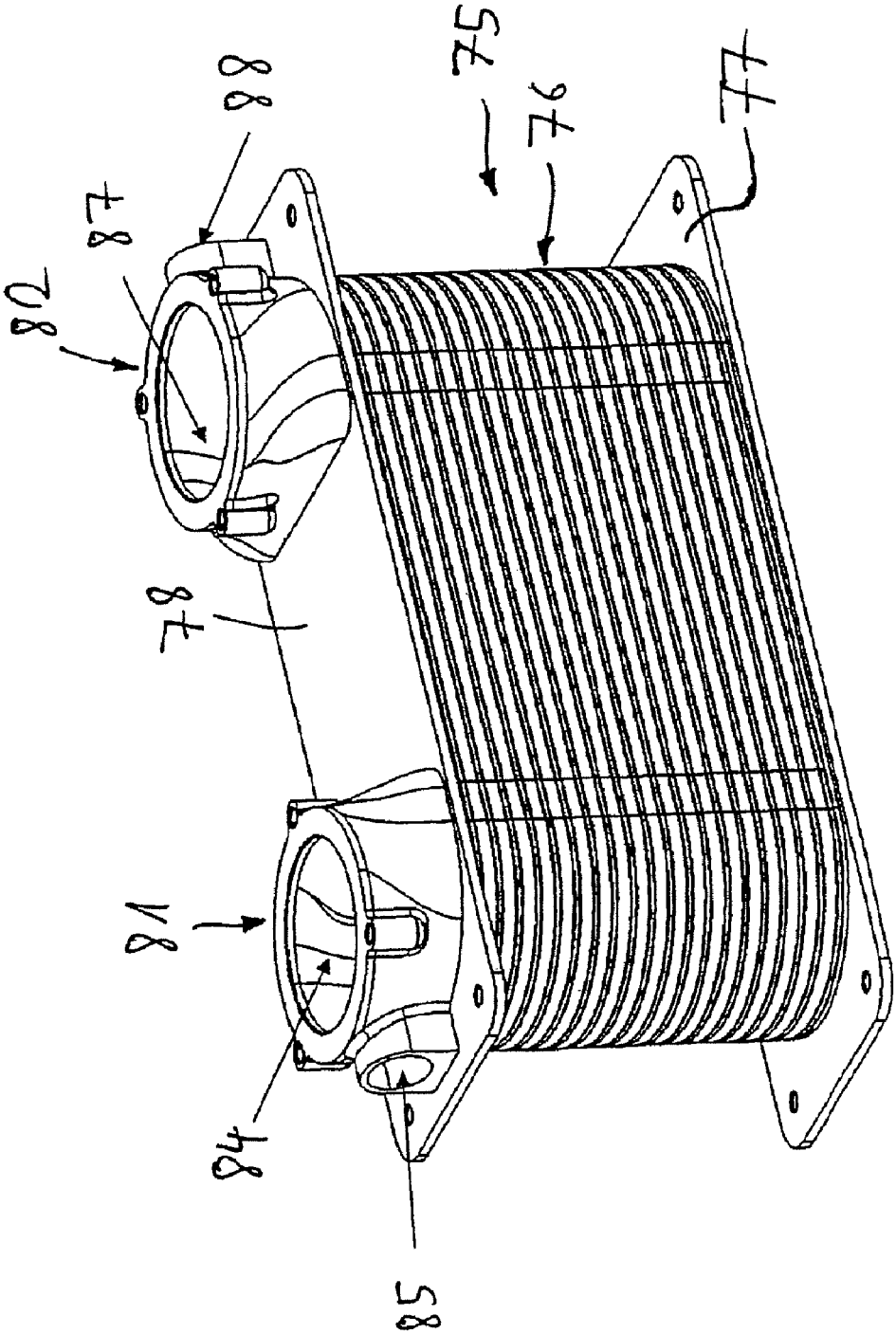

FIGS. 6 to 8 illustrate the connection housing 66 on its own in various views. The encircling coolant duct 69 serves to keep the outer temperature of the connection housing 66 low. It can be seen in the section view illustrated in FIG. 8 that the encircling coolant duct 69 completely surrounds the charge-air connection duct 67 in cross section.

FIG. 9 illustrates a charge-air cooler 75 according to one exemplary embodiment of the invention in a perspective view. The charge-air cooler 75 comprises a stacked-plate block 76 with a plurality of stacking plates. The stacked-plate block 76 is for example designed like the stacked-plate block 6 illustrated in FIGS. 1 and 2. The stacked-plate block 76 can however also be designed like the stacked-plate block 26 illustrated in FIGS. 3 and 4. FIG. 5 illustrates a perspective section view through the charge-air cooler 75. However, different reference symbols are used in FIG. 5 than in FIG. 9.

The stacked-plate block 76 illustrated in FIG. 9 is arranged between a base plate 77 and a cover 78. A charge-air inlet connection housing 81 and a charge-air outlet connection housing 82 are soldered onto the cover 78. The connection housings 81 and 82 can also be formed in one piece, for example as a cast part, with the cover 78. The charge-air inlet connection housing 81 comprises a charge-air inlet connection 84 and a coolant outlet connection 85. The charge-air outlet connection housing 82 comprises a charge-air outlet connection 87 and a coolant inlet connection 88.

The design of the charge-air cooler 75 according to the invention provides the advantage that the component outer temperature can be kept below 200 degrees Celsius. The design of the charge-air cooler 75 according to the invention also reduces the production costs. The charge-air cooler according to the invention also provides more variable connection possibilities than conventional charge-air coolers. The temperature gradients which occur in operation of the charge-air cooler can also be reduced. In this way, it is possible to permit greater structure heights. The maximum component outer temperature is determined by the maximum coolant temperature and is preferably less than 200 degrees Celsius. Use on ships is therefore possible. Boiling of the coolant is also reliably prevented. Improved durability and a higher capacity of the charge-air cooler are also permitted. By using solderable cast material, it is possible to dispense with welding of connection parts after the soldering. The use of a cast part also provides the advantage that the connections to further components can be realized in a flexible manner.

It is possible with the charge-air cooler according to the invention to realize both series and parallel connections of several coolers. The component temperature is reduced to the level of the coolant temperature even in the region of the charge-air inlet. In this way, it is possible for undesired stresses in the charge-air cooler to be significantly reduced. As a result of said measure, greater structure heights are possible, that is to say it is possible to stack a greater number of stacking plates one on top of the other. It is also possible for the pressure loss of the charge-air cooler on the charge-air side and on the coolant side to be reduced and for a higher heat output to be transferred.

Figure 10:
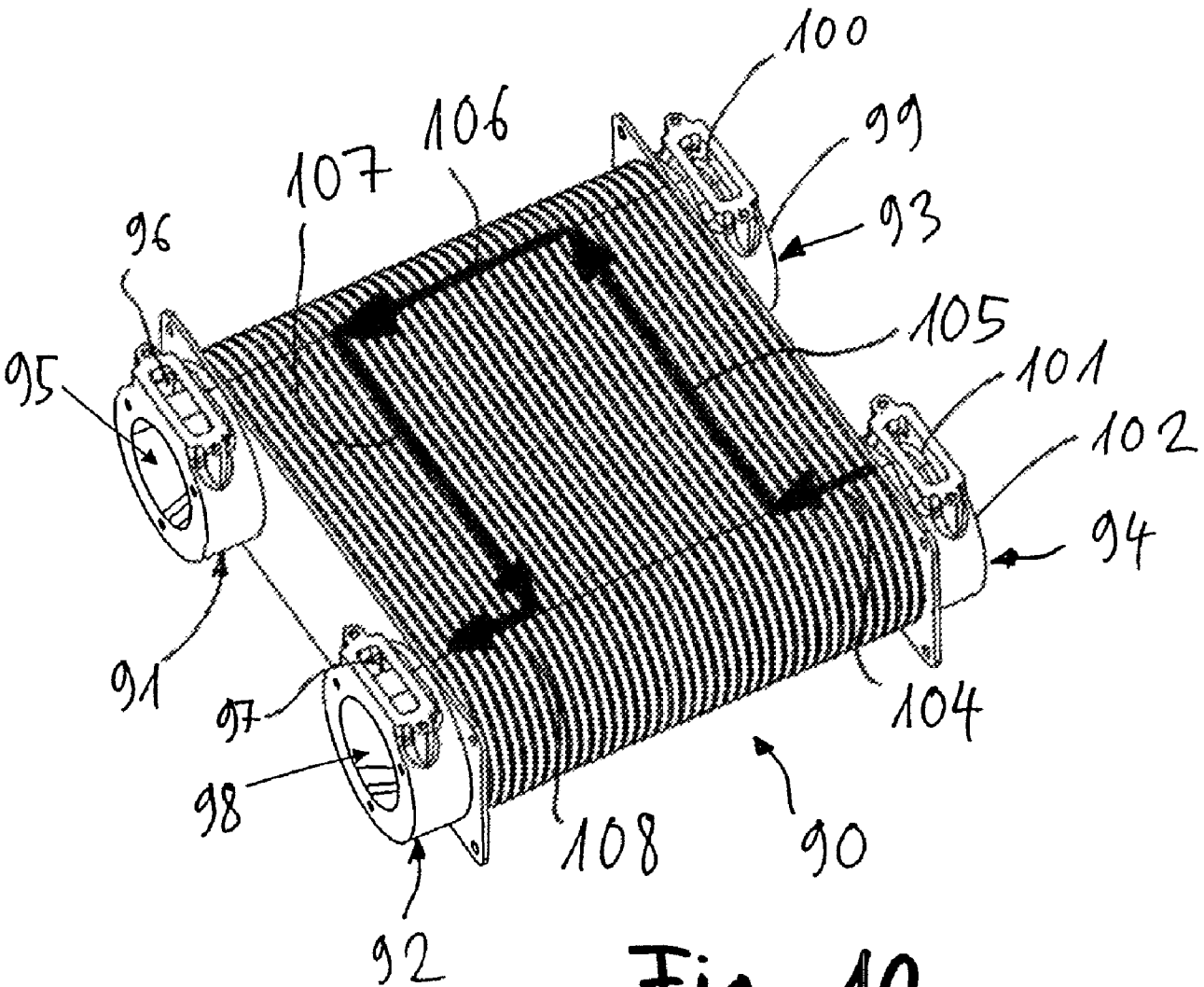
FIG. 10 shows a further perspective illustration of a stacked-plate heat exchanger as per a further exemplary embodiment.

FIG. 10 illustrates a charge-air cooler 90 which has four connection housings 91 to 94. The connection housing 91 comprises a first charge-air inlet connection 95 and a first coolant outlet connection 96. The connection housing 92 comprises a first coolant inlet connection 97 and a first charge-air outlet connection 98. The connection housing 93 comprises a second charge-air inlet connection 99 and a second coolant outlet connection 100. The connection housing 94 comprises a second coolant inlet connection 101 and a second charge-air outlet connection 102.

According to a further exemplary embodiment, the charge-air connections 95 and 99 can also be closed off. In this case, the charge air would enter through the charge-air connection 102 of the connection housing 94 into the charge-air cooler 90. Arrows 104 to 108 indicate the profile of the charge air in the charge-air cooler 90. In the charge-air cooler 90, the charge air would firstly pass through a high-temperature circuit and then through a low-temperature circuit, and would exit out of the charge-air cooler 90 at the charge-air outlet 98 of the connection housing 92. The connection housing 93 would in this case have only one high-temperature coolant inlet connection. The associated high-temperature coolant outlet connection 101 would be provided in the connection housing 94. The connection housing 91 would then comprise only one low-temperature coolant inlet connection. The associated low-temperature coolant outlet connection 97 would then be provided in the connection housing 92.

Figure 11:
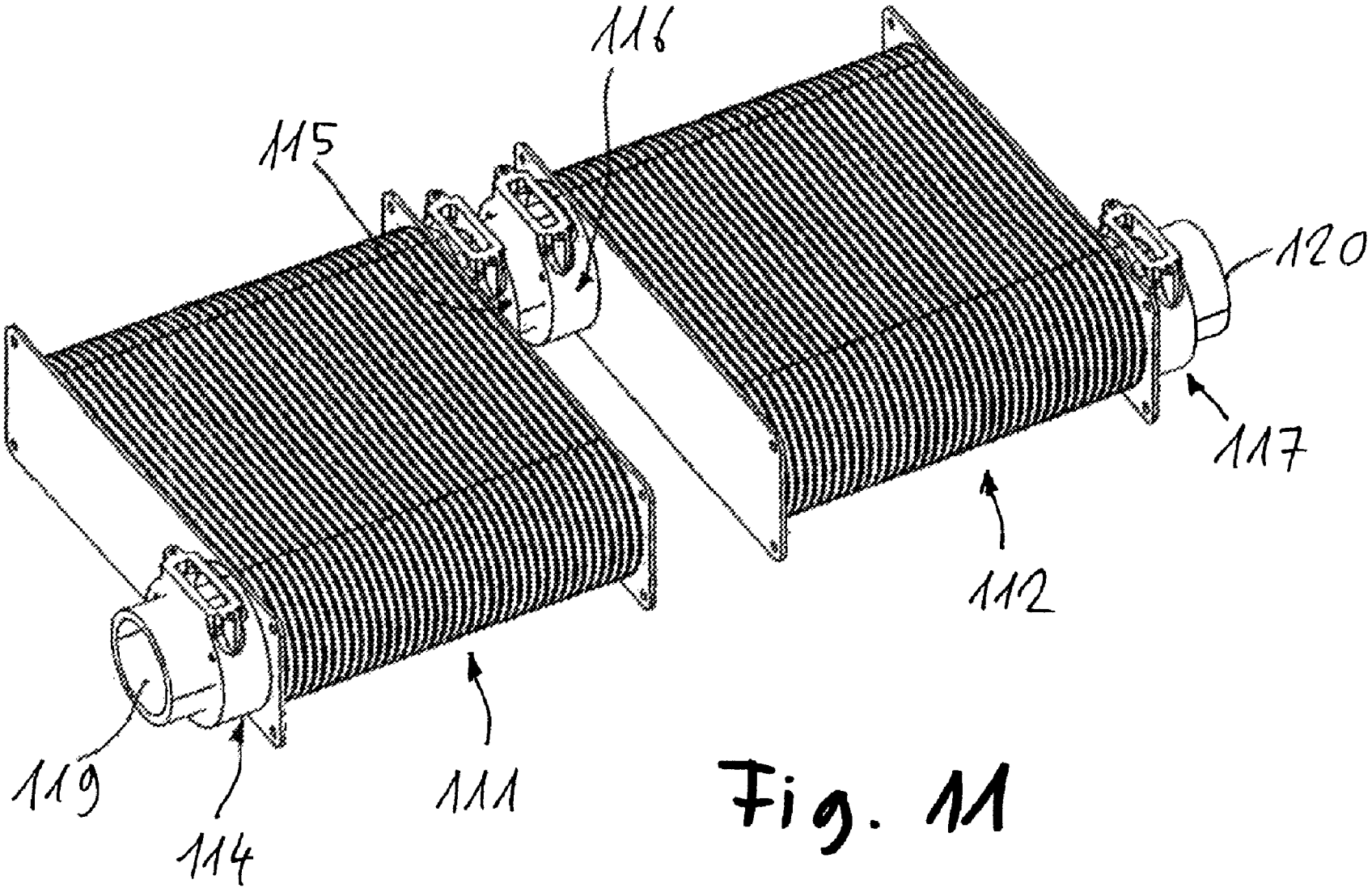
FIG. 11 shows a perspective illustration of two stacked-plate heat exchangers connected to one another.

FIG. 11 illustrates, in a perspective view, the realization of a high-temperature circuit and of a low-temperature circuit with two charge-air coolers 111, 112 according to the invention. The first charge-air cooler 111 comprises a low-temperature coolant inlet connection housing 114 and a low-temperature coolant outlet connection housing 115. Connected to the low-temperature coolant outlet connection housing 115 is a high-temperature coolant inlet connection housing 116 of the second charge-air cooler 112. The second charge-air cooler 112 also has a high-temperature coolant outlet connection housing 117. The first charge-air cooler 111 therefore forms a low-temperature charge-air cooler. The second charge-air cooler 112 forms a high-temperature charge-air cooler. The charge air enters into the first charge-air cooler 111 through a charge-air inlet connection 119, through the low-temperature coolant inlet connection housing 114. The high-temperature coolant outlet connection housing 117 is provided with the associated charge-air outlet connection 120.

The invention claimed is:

1. A stacked-plate heat exchanger comprising:

a plurality of elongated plates which are stacked one on top of the other and are connected to one another, wherein the plates form a first cavity and are configured such that a flow of a medium to be cooled is flowable through the first cavity in a longitudinal direction of the plates, wherein the plates form a second cavity and are configured such that a flow of a coolant is flowable through the second cavity, wherein each of the plates comprises an inlet connection opening for the medium to be cooled and an outlet connection opening for the medium to be cooled, each of the inlet connection opening and the outlet connection opening comprising an arc-shaped edge, wherein each of the plates comprises at least one arc-shaped coolant connection opening extending in an arc at least partially around the arc-shaped edge of at least one of the inlet connection opening and the outlet connection opening, and wherein the arc-shaped coolant connection opening comprises two arc-shaped edges that curve in a same direction.

2. The stacked-plate heat exchanger as claimed in claim 1, wherein the at least one arc-shaped coolant connection opening comprises a plurality of arc-shaped coolant connection openings, each of which extends in an arc partially around the arc-shaped edge of the at least one of the inlet connection opening and the outlet connection opening.

3. The stacked-plate heat exchanger as claimed in claim 1, wherein the at least one arc-shaped coolant connection opening comprises a coolant inlet connection opening which extends at least partially around the outlet connection opening for the medium to be cooled.

4. The stacked-plate heat exchanger as claimed in claim 1, wherein the at least one arc-shaped coolant connection opening comprises a plurality of coolant inlet connection openings, each of which extends at least partially around the outlet connection opening for the medium to be cooled.

5. The stacked-plate heat exchanger as claimed in claim 1, wherein at least one of the inlet connection opening and the outlet connection opening has a shape of a circular segment, an annular segment, or a semi-circle.

6. The stacked-plate heat exchanger as claimed in claim 1, wherein an additional coolant connection opening is located in a region of a geometric center of the arc-shaped edge of at least one of the inlet connection opening and the outlet connection opening.

7. The stacked-plate heat exchanger as claimed in claim 1, further comprising a connection housing which comprises a connection for the medium to be cooled and a connection for the coolant.

8. The stacked-plate heat exchanger as claimed in claim 7, wherein the connection housing comprises an encircling duct for the coolant which extends around a connection duct for the medium to be cooled.

9. The stacked-plate heat exchanger as claimed in claim 1, wherein the elongated plates are formed of solderable aluminum.

10. A stacked-plate heat exchanger comprising:

a plurality of elongated plates which are stacked one on top of the other and are connected to one another, wherein the plates form a first cavity and are configured such that a flow of a medium to be cooled is flowable through the first cavity in a longitudinal direction of the plates, wherein the plates form a second cavity and are configured such that a flow of a coolant is flowable through the second cavity, wherein each of the plates comprises an inlet connection opening for the medium to be cooled and an outlet connection opening for the medium to be cooled, each of the inlet connection opening and the outlet connection opening comprising an arc-shaped edge, wherein at least one first coolant connection opening extends partially around at least one of the inlet connection opening and the outlet connection opening, and wherein a second coolant connection opening is located in a region of a geometric center of the arc-shaped edge of at least one of the inlet connection opening and the outlet connection opening.

11. A stacked-plate heat exchanger comprising:

a plurality of elongated plates which are stacked one on top of the other and are connected to one another, wherein the plates form a first cavity and are configured such that a flow of a medium to be cooled is flowable through the first cavity in a longitudinal direction of the plates, wherein the plates form a second cavity and are configured such that a flow of a coolant is flowable through the second cavity, wherein each of the plates comprises an inlet connection opening for the medium to be cooled and an outlet connection opening for the medium to be cooled, each of the inlet connection opening and the outlet connection opening comprising an arc-shaped edge, wherein each of the plates comprises at least one arc-shaped coolant connection opening extending in an arc at least partially around the arc-shaped edge of at least one of the inlet connection opening and the outlet connection opening, wherein the stacked-plate heat exchanger further comprises a connection housing which comprises a connection for the medium to be cooled and a connection for the coolant, and wherein the connection housing comprises an encircling duct for the coolant which extends around a connection duct for the medium to be cooled.

* * * * *